US006827565B1

(12) United States Patent
Vogelsang

(10) Patent No.: US 6,827,565 B1
(45) Date of Patent: Dec. 7, 2004

(54) ROTATING PISTON PUMP

(75) Inventor: Harald Vogelsang, Essen (DE)

(73) Assignee: Hugo Vogelsand Maschinenbau GmbH, Essen (DE)

( * ) Notice: Subject to any disclaimer, the term of this patent is extended or adjusted under 35 U.S.C. 154(b) by 0 days.

(21) Appl. No.: 10/181,161

(22) PCT Filed: May 18, 2000

(86) PCT No.: PCT/EP00/04519

§ 371 (c)(1),
(2), (4) Date: Sep. 25, 2002

(87) PCT Pub. No.: WO01/88377

PCT Pub. Date: Nov. 22, 2001

(51) Int. Cl.[7] ..... F04C 2/16; F04C 2/18

(52) U.S. Cl. ..... 418/178; 418/201.1; 418/206.9

(58) Field of Search ..... 418/1, 153, 154, 418/178, 201.1, 206.9; 92/204; 277/472

(56) References Cited

U.S. PATENT DOCUMENTS

| | | | | | |
|---|---|---|---|---|---|
| 2,455,194 | A | * | 11/1948 | Rumsey | 418/154 |
| 2,605,715 | A | * | 8/1952 | Brant | 418/153 |
| 2,999,466 | A | * | 9/1961 | Hornschuch et al. | 418/178 |
| 3,078,807 | A | * | 2/1963 | Thompson | 418/153 |
| 3,832,105 | A | | 8/1974 | Takahashi | 418/154 |
| 3,999,894 | A | * | 12/1976 | Nakayama et al. | 417/269 |
| 4,270,440 | A | * | 6/1981 | Lewis, II | 92/87 |
| 4,622,804 | A | | 11/1986 | Krone et al. | 56/13.9 |
| 4,940,402 | A | * | 7/1990 | McCormick | 418/154 |
| 5,988,649 | A | * | 11/1999 | Van Ryper et al. | 277/435 |

FOREIGN PATENT DOCUMENTS

| | | | | |
|---|---|---|---|---|
| DE | 3324899 | | 7/1983 | |
| DE | 8602009 | | 7/1987 | |
| DE | 3707722 | * | 9/1988 | 418/178 |
| DE | 4313457 | | 5/1994 | |
| FR | 1209705 | | 3/1960 | |

* cited by examiner

*Primary Examiner*—John J. Vrablik
(74) *Attorney, Agent, or Firm*—Jordan and Hamburg LLP

(57) ABSTRACT

A pump (1) with one or more pistons (3; 103; 203; 303; 403), which can be rotated, especially for conveying essentially liquid media, the piston (3; 103; 203; 303; 403), having at least regionally a surface layer (17; 117; 217; 317; 417) of a polymer, especially of an elastomer, is constructed so that at least one recess (19; 119; 219; 319; 419), into which a supporting body (20; 120; 220; 320; 420) can be introduced for expanding the polymer layer (17; 117; 217; 317; 417), is assigned to the polymer layer.

11 Claims, 8 Drawing Sheets

ROTATING PISTON PUMP

BACKGROUND OF THE INVENTION

The inventions relates to a pump with one or more pistons which can be rotated, as well as to a method for compensating for abrasion-wear of a pump piston.

For rotating piston pumps, especially for conveying liquids laden with solids, there must be a seal between the rotating piston or pistons and the wall of the pump space and, in the case of several pistons, also between the individual pistons. The efficiency achieved varies with the quality of the seal with the wall and the quality of the seal between the pistons.

The DE 20 02 518 C3 shows an elastomeric coating for rotating pistons of pumps, which are used to convey solid-laden suspensions. Such a coating can yield elastically, if solid particles penetrate into the gap between the piston and the wall or into the gap between the rotating pistons, which are as close to one another, as possible. By these means, blockage of the rotational movement by solids is prevented.

However, the outer elastic layer or the piston is subject to increased wear, particularly by such particles penetrating into the respective gap. As the wear increases, the thickness of the plastic layer becomes less and, with that, the gap between the piston or pistons and the wall becomes greater, as a result of which the efficiency of the pump decreases. However, an exchange of pistons, which then becomes necessary, is very expensive.

The EP 0 599 333 B1 therefore shows piston parts, which can be exchanged individually, without having to exchange the whole piston. For this purpose, the blade tips are constructed as sealing strips, which can be slipped on and are fastened in a dovetail guide and can be exchanged when necessary. However, the manufacturing costs of such a design are very high. Moreover, in the case of multi-bladed pistons, all piston tips generally must be exchanged simultaneously, so that the maintenance costs, as a whole, are increased for such an exchange, since the number of parts, which must be exchanged, has grown appreciably in comparison to exchanging a piston. Moreover, the practical construction of such a dovetail guide is very expensive.

SUMMARY OF THE INVENTION

It is an object of the invention to counteract the wear-induced abrasion of an outer polymer layer of a pump piston with the least possible expense.

An adjustment of the outer, wear layer of the piston is made possible by the inventive construction of a pump. Due to the introduction, as required, of a supporting body in the designated recess, a thinning of the material of the polymer layer can be taken into account, in that the recess is expanded by introducing the supporting body. By these means, the polymer layer is stretched approximately to its original thickness. Such a recess can extend essentially along a line of contact between the piston and the wall of the pump space and thus counteract a radial thinning of the outer polymer layer by introducing a supporting body. The recess can also be disposed essentially perpendicularly to the axis of rotation, so that the introduction of the supporting body expands the piston regions, which form a seal, transversely to the axial course against the wall of the pump space and are also exposed to wear.

If an assortment of different supporting bodies of different dimensions is available, a wear-related material thinning of different extent can be taken into account particularly advantageously.

BRIEF DESCRIPTION OF THE DRAWINGS

Further advantages and details arise out of the example of the object of the invention which are described in the accompanying drawings.

FIG. 4 shows the diagrammatic course of the polymer layer, in the original state, worn on the outside and expanded by introducing an enlarged supporting body, in a diagrammatic, truncated plan view, in which FIG. 4*a* shows the original state, FIG. 4*b* shows the piston with the polymer layer partly worn, FIG. 4*c* shows the piston with the diameter enlarged by the introduced supporting body and the resulting expanded wear layer.

Figure 1:
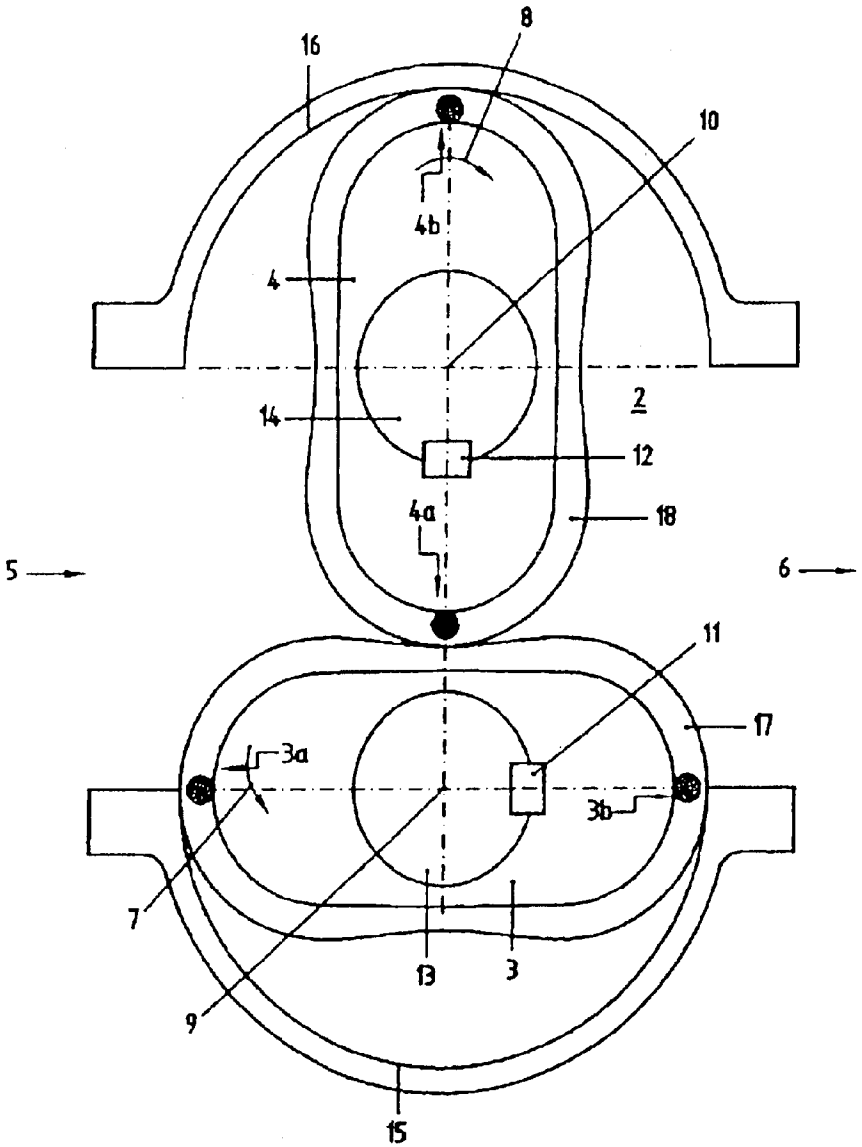
FIG. 1 shows a diagrammatic plan view of a two-bladed rotating piston pump with, in each case, a polymer layer surrounding the pistons and with supporting bodies introduced parallel to the axis.

The pump 1 of the construction shown in FIG. 1 has a pump space 2, in which two pistons 3, 4 of similar construction roll on one another and convey a liquid from an inlet gap 5 to an outlet opening 6. The pistons 3 and 4 each are constructed as two-blade pistons. However, this is not essential. The pistons run in the direction of the arrows 7, 8 about the axes of rotation 9, 10 and are held removably on the shafts 13, 14 by feather keys 11, 12.

DESCRIPTION OF THE PREFERRED EMBODIMENTS

Figure 2:
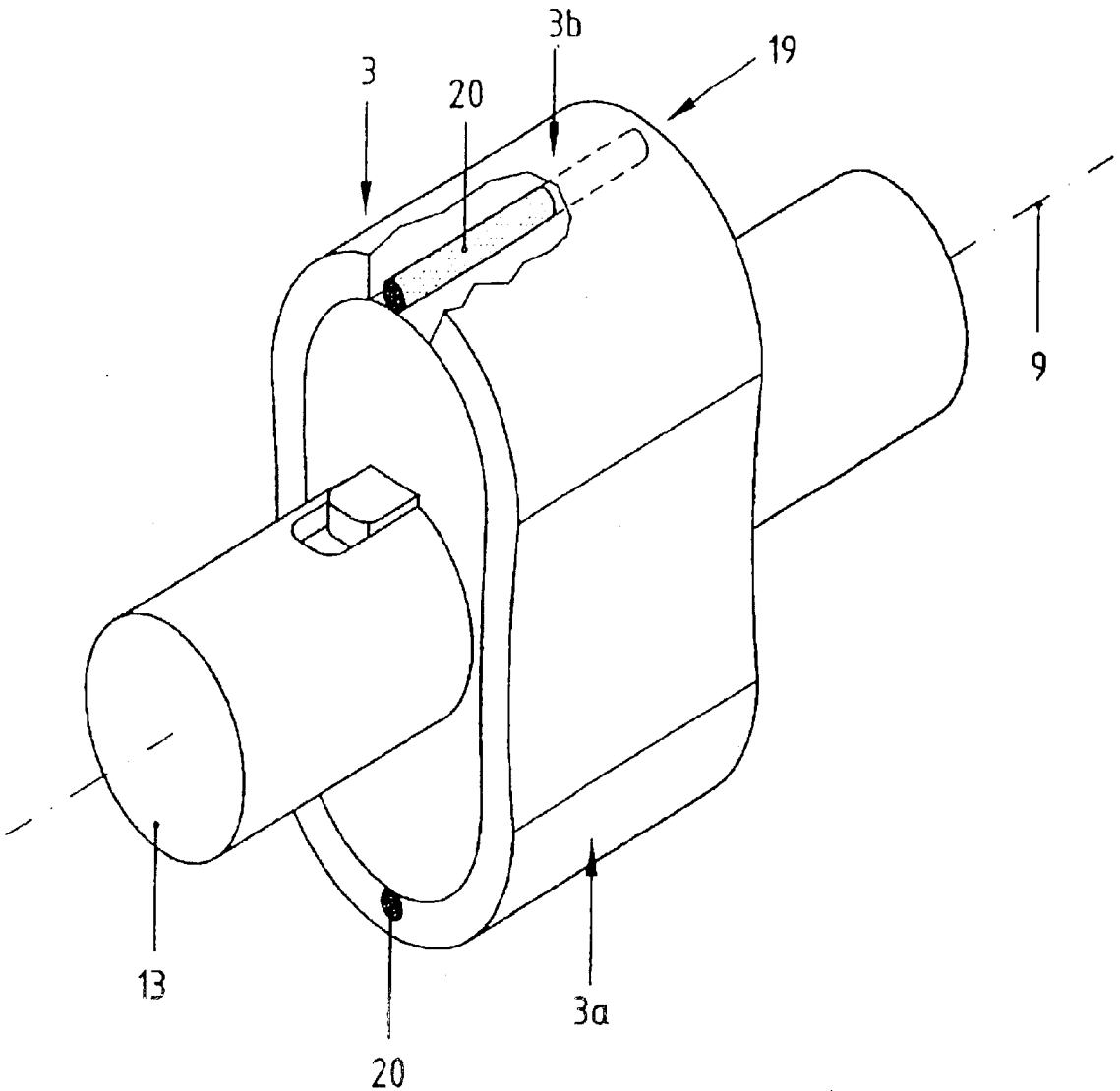
FIG. 2 shows a piston of FIG. 1 in a perspective, partially broken open representation.

During the rotation, the blade tips 3*a*, 3*b* and 4*a*, 4*b* pass closely by the walls 15, 16 of the pump space 2 as well as by the respective other piston 3 or 4. On the outside, the pistons 3, 4 are surrounded, at least at the highly stressed blade tips 3*a*, 3*b* and 4*a*, 4*b*, by a layer of an elastic polymer, especially by a layer of elastomer. These form a seal between the pistons 3, 4 and between the pistons 3, 4 and the walls 15, 16 of the pump space 2. In the piston of FIG. 1 (see also FIG. 2), a recess is disposed within the layer 17, 18 of elastomer in the blade tips 3*a*, 3*b*, 4*a*, 4*b*, extends parallel to the axis of rotation 9 or 10 and is provided to accommodate a supporting body 20. According to the example, the recess 19 is disposed completely within the layer 17 and 18 of elastomer. It is also possible to dispose such a recess 19 between the layer of elastomer and the piston, especially the metallic piston, below this layer.

Figure 3:
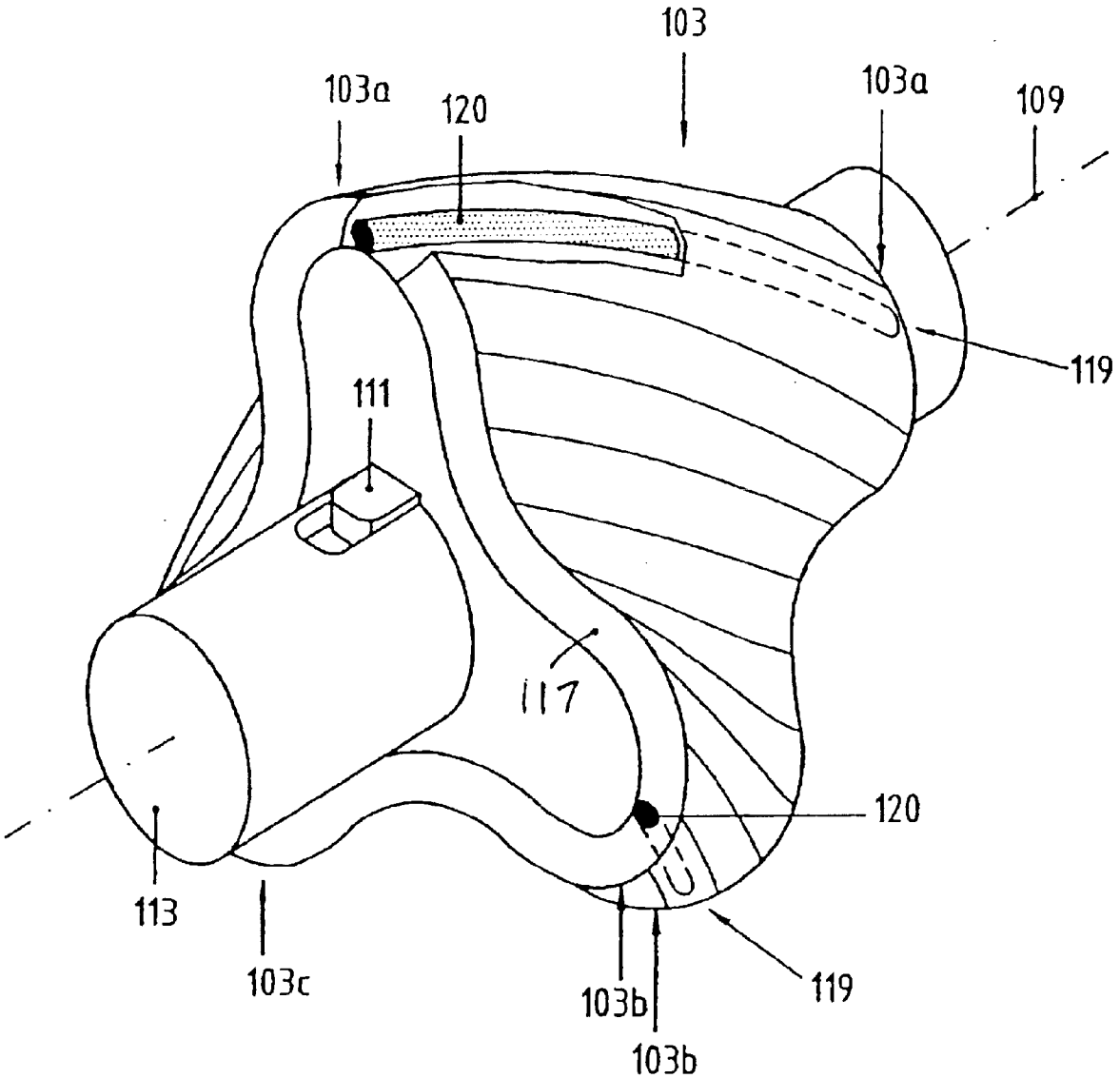
FIG. 3 shows a twisted piston with recesses, following its maximum radial extent, and introduced supporting bodies in a perspective, partially broken open representation.

FIG. 3 shows a twisted piston 103, which is also fixed by means of a feather key 111 on a shaft 113 and can be rotated about an axis of rotation 109. The recesses 119 in the surface layer 117 are introduced spirally into the blade tips 103*a*, 103*b*, 103*c*, which also extend spirally with respect to the shaft 113. The introduced supporting bodies 120, which are shown here, may be flexible or produced with an appropriate curvature. In the example, the piston 103 has three blades. Once again, this is not essential. Several pistons 103 can slide on one another in a pump 1.

Figure 5:
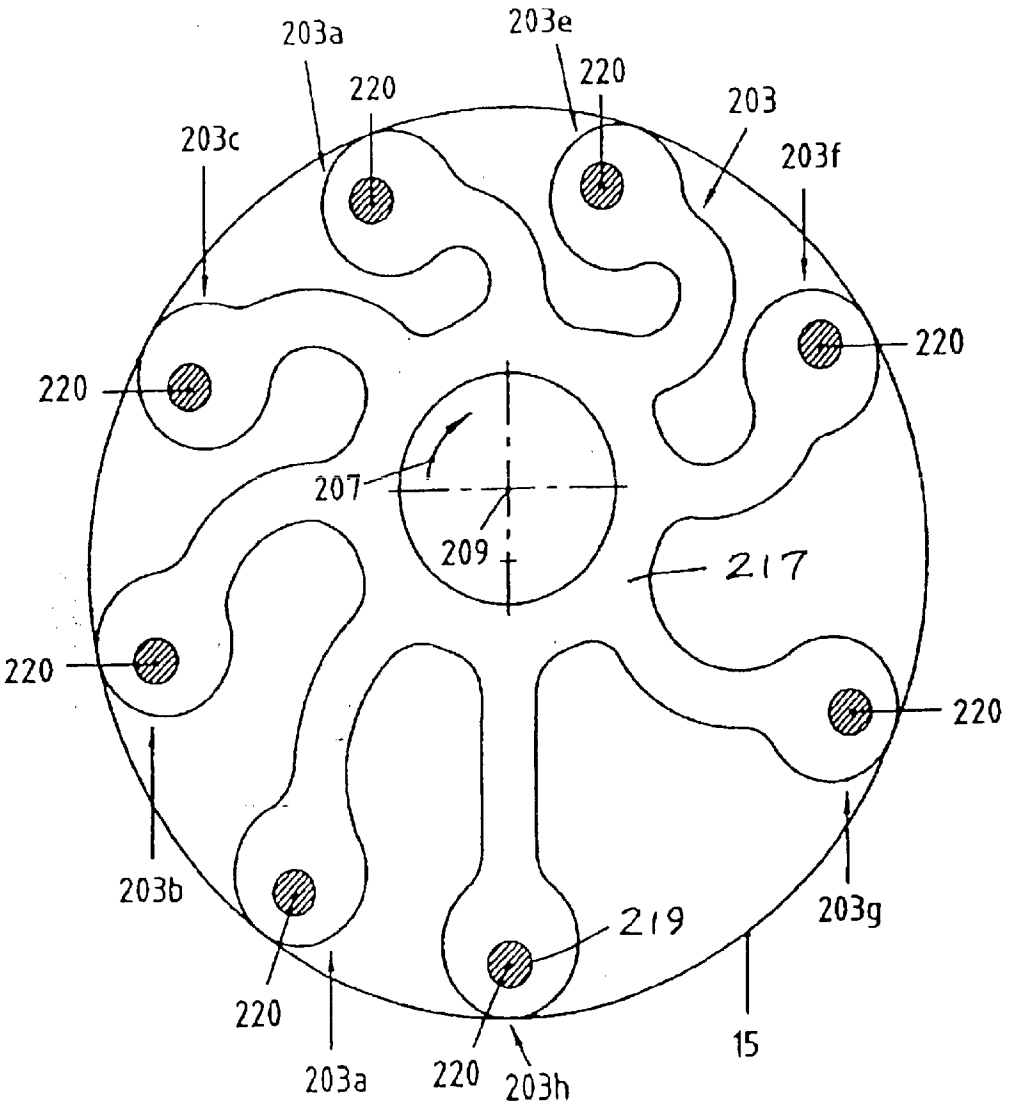
FIG. 5 shows a rotating piston pump with a multi-blade, flexible rotating piston.

In a further example (FIG. 5), a multi-blade piston (eight blades) 203 of a rotary vane pump is shown. The piston is held on a shaft 213 and rotates in the direction 207 about an axis of rotation 209. The piston 203 has a surface layer 217, which consists completely of a polymer and surrounds the piston 203 essentially completely. In the piston tips 203*a* to 203*h*, the recesses 219 are molded essentially parallel to the axis and can accommodate supporting bodies 220.

Figure 6:
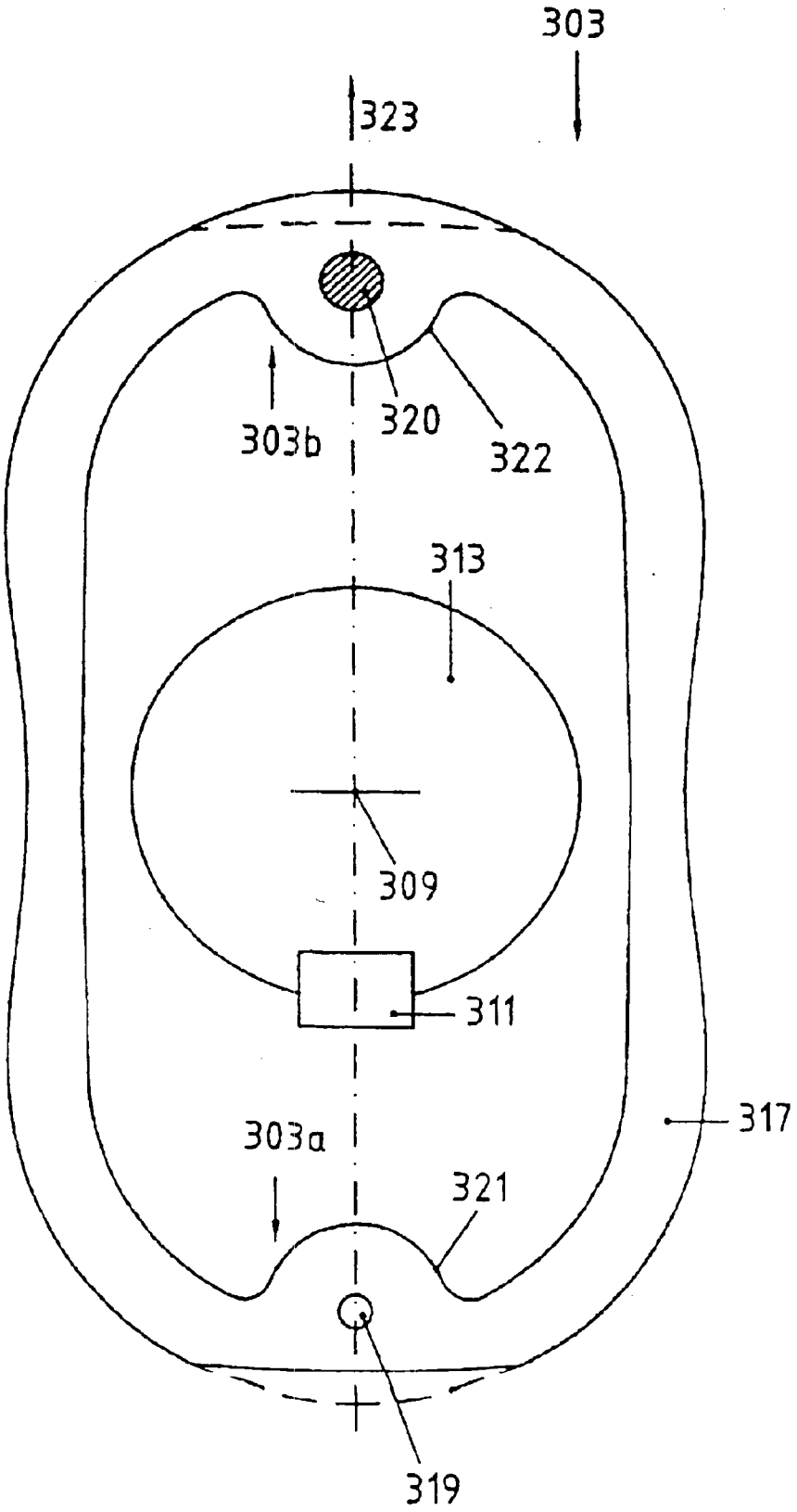
FIG. 6 shows a piston in a view similar to that of FIG. 1, the outer periphery of the piston and the polymer layer being matched to one another and held to prevent rotation relative to one another.

In FIG. 6, a further piston 303 is shown, which corresponds essentially to piston 3 in FIG. 1, but has moldings 321 and 322 at the blade tips 303*a* and 303*b*, in order to ensure, by these means, that the polymer layer 317 is held securely, so that it does not lift off and also does not rotate. At the lower end in FIG. 6 (blade tip 303*a*), a recess 319, which is constructed as a channel parallel to the axis, is shown before a supporting body is introduced. A flattening of the outer polymer layer 317, which has resulted from wear, can be seen here. At the upper blade tip. 303*b*, the situation after the introduction of a supporting body 320 is shown. As a result of this introduction, the recess 319 is expanded and, accordingly, the surrounding elastomeric layer is stretched in the direction of arrow 323.

Figure 7:
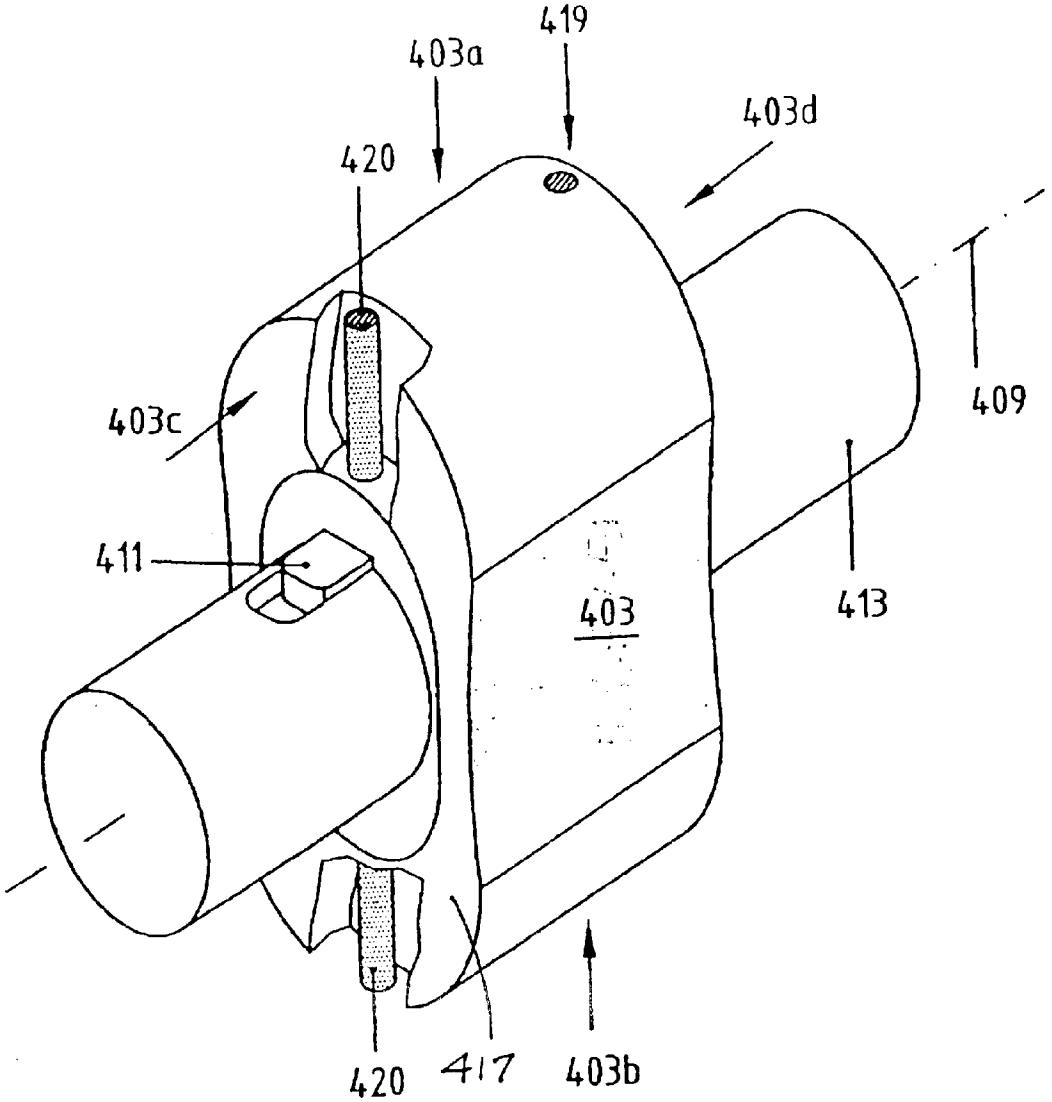
FIG. 7 shows a view, similar to that of FIG. 2, of a piston which has recesses for supporting bodies at edge regions, which are at a distance from one another axially, the supporting bodies, which have been introduced, extending transversely to the axial extent.
Figure 8:
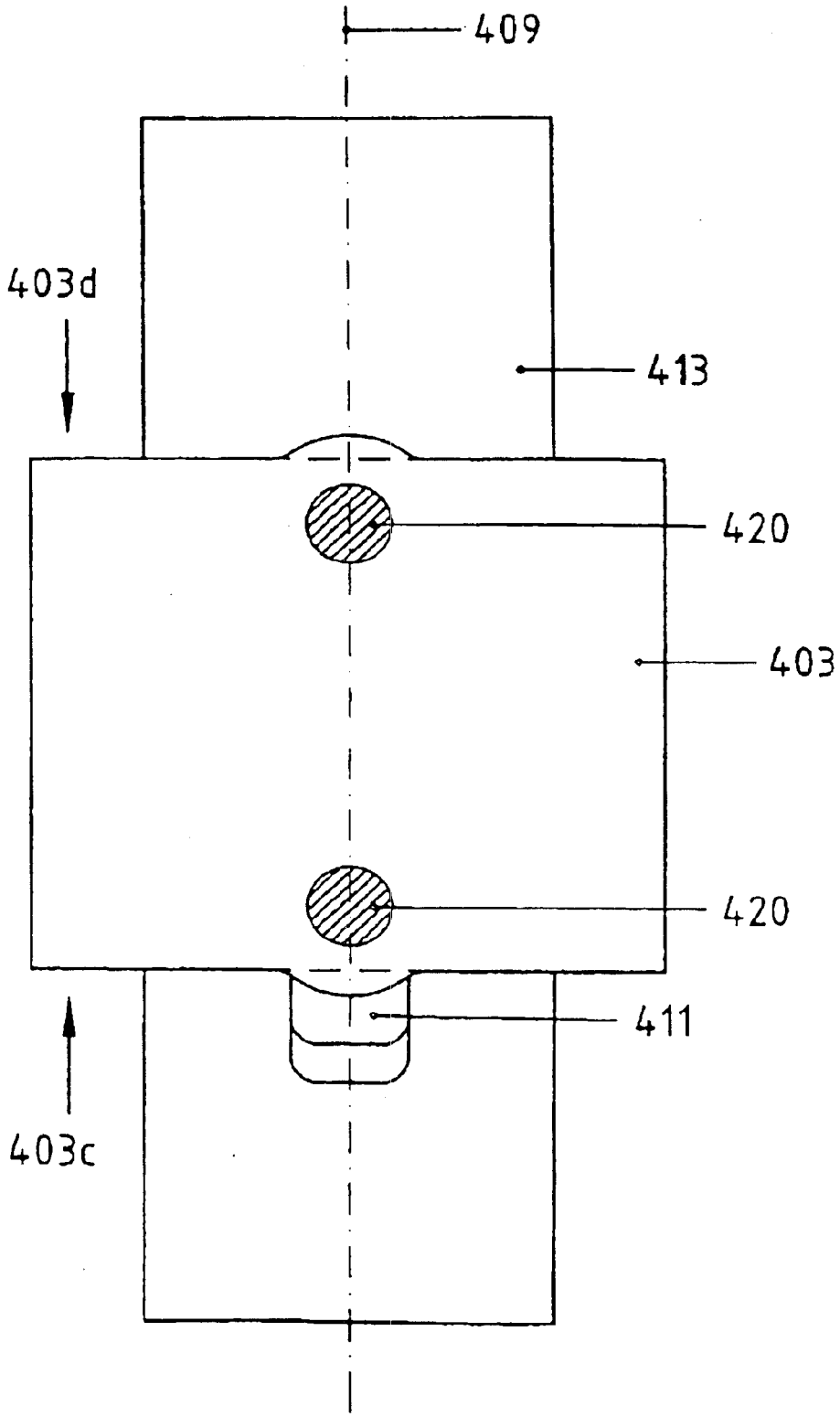
FIG. 8 shows a plan view of FIG. 7.

In the embodiment of FIGS. 7 and 8, a piston 403 includes recesses 419 which extend perpendicularly to the axis of rotation 409, and which are formed in a polymer surface layer 417 present in a region of the piston edges 403*a*, 403*b*. By introducing supporting bodies 420, the upper and lower boundary planes defining the piston edges 403*c*, 403*d*, and which are perpendicular to the axis of rotation 409, are expanded. As a result, an expansion of the areas, which extend transversely, is also possible instead of, or in addition to, the expansion of the blade tips.

Figures 4, 4A, 4B, 4C:
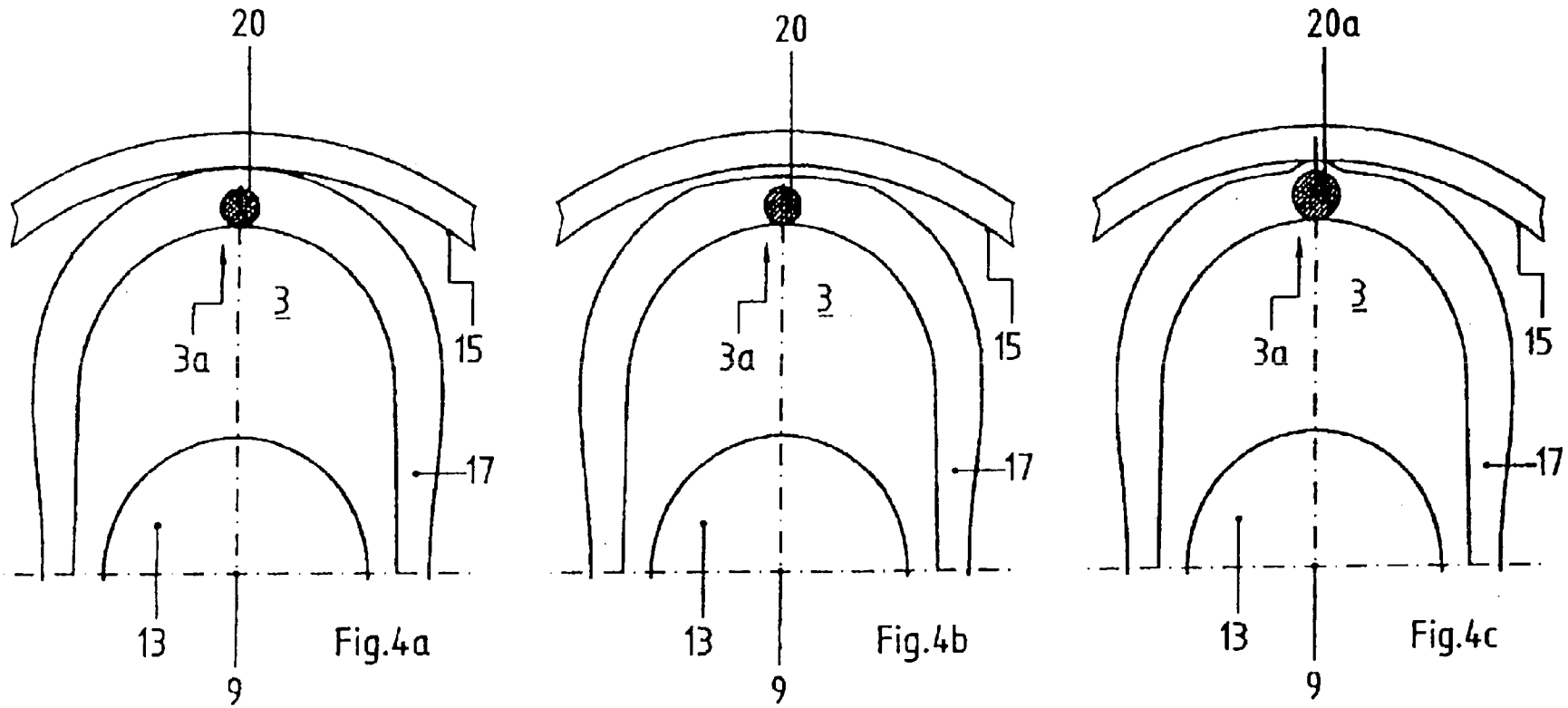

In FIG. 4, the course of the inventive method for compensating for wear at the outer polymer layer is shown. In FIG. 4*a*, the polymer layer 17 is intact also in the region of the blade tip 3*a* and has its full, original width. A supporting body 20, such as a steel or plastic stud, the diameter of which corresponds to that of the channel formed by the recess 19, is introduced into the recess 19.

In the representation of FIG. 4*b*, the polymer layer 17 is thinned and a gap is formed between the wall 15 and the outer boundary of the piston 3.

For this reason, the supporting body 20 is removed and a supporting body 20*a*, the periphery of which is expanded, is inserted. Due to its larger diameter, the supporting body 20*a* brings about an expansion of the recess 19 and, with that, also of the polymer layer 17 surrounding it, so that this expansion once again closes the gap that had been formed (FIG. 4*c*).

On the one hand, an existing supporting body 20 can be exchanged for an expanded supporting body 20*a*. On the other, it is also possible that, originally, a supporting body 20 was not vulcanized in the recess 19. In that case, either an existing borehole is expanded by introducing a supporting body 20*a*, which is oversized with respect to the borehole, or a borehole with a diameter of 2 mm to 3 mm, for example, is introduced and an oversized supporting body 20*a* of, for example, 10 mm to 12 mm is pushed into the recess. Because an expulsion of an earlier supporting body 20 of smaller diameter is omitted in this procedure, the polymer layer 17 can be expanded in this way without removing the respective piston 3,103, 203, 303 or 403.

Grubscrews with a self-cutting thread can be used particularly advantageous as supporting bodies 20, 20*a*. They can also be unscrewed once again from the recesses 19, even when the piston 3 is inserted, so that an expulsion of a supporting body 20, which would require removal of the piston 3, is unnecessary for exchanging the supporting bodies 20, 20*a*. Supporting bodies with a thread may also consist of different materials and optionally be curved.

An assortment of supporting bodies 20, 20*a*, 120, 220, 320, 420 of different diameters with or without a thread, can be kept on hand. In order to decide, which supporting body is to be fitted in, the gap between the wall 15 and the elastomeric layer 17 is measured first and the appropriately fitting supporting body 20 or 20*a*, 120, 220, 320, 420 is then selected.

The supporting body need not have the circular, cross sectional configuration shown in FIG. 4*c*. In adaptation to the thinned region, it may also, for example, have an oval, elliptical or a differently shaped peripheral configuration. It is also possible to provide several recesses 19 next to one another, as a result of which the expanded region as a whole is enlarged.

Overall, an elastic deformation of the layer 17 is achieved, which also experiences therewith an expansion towards the outside and accordingly compensates for wear-induced thinning of the material.

What is claimed is:

1. A pump, comprising:

at least one piston which can be rotated, the piston having, at least regionally, a surface layer of a polymer, said surface layer including at least one recess therein; and a supporting body receivable in a respective one of said at least one recess, said supporting body being sized larger than a cross-section of said respective one of said at least one recess such that when received therein, the polymer layer is expanded in a region of said supporting body.

2. The pump according to claim 1, wherein the at least one recess is disposed within the polymer layer.

3. The pump according to claim 1, wherein the at least one recess extends essentially perpendicularly to an axis of rotation of the at least one piston and is placed in the region of piston edges, which are perpendicular to the axis.

4. The pump according to claim 1, wherein the said at least one piston includes multi-blade pistons and each blade is provided with at least one of said at least one recess in the region of its contact with a surrounding wall of a pump space.

5. The pump according to claim 1, wherein said at least one piston includes two rotating pistons which slide on one another.

6. The pump according to claim 1, wherein said at least one piston includes at least one rotating piston which twists over an axial course of the pump, and the at least one recess follows a line of maximum radial extent of said at least one rotating piston.

7. The pump according to claim 1, wherein the recess can be expanded, as required, by selectively introducing supporting bodies of different diameters.

8. The pump according to claim 1, wherein the supporting body is formed by a metal stud.

9. The pump according to claim 1, wherein the at least one recess is constructed as a channel for accommodating an essentially rod-shaped supporting body.

10. The pump according to claim 9, wherein:

the pump includes a wall surrounding a pump space; and the channel is located in a region of a line of contact between the piston and the wall of the pump space.

11. The pump according to claim 9, wherein the channel is aligned essentially parallel to a rotational axis of the piston.

* * * * *

UNITED STATES PATENT AND TRADEMARK OFFICE

CERTIFICATE OF CORRECTION

PATENT NO. : 6,827,565 B1
DATED : December 7, 2004
INVENTOR(S) : Harald Vogelsang It is certified that error appears in the above-identified patent and that said Letters Patent is hereby corrected as shown below:

Title page,
Item [73], Assignee, "Hugo Vagelsand Maschinenbau GmbH" to
-- Hugo Vagelsang Maschinenbau GmbH --.

Signed and Sealed this

Seventh Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,827,565 B1
APPLICATION NO. : 10/181161
DATED : December 7, 2004
INVENTOR(S) : Harald Vogelsang It is certified that error appears in the above-identified patent and that said Letters Patent is hereby corrected as shown below:

Title page,
Item [73], Assignee, "Hugo Vagelsand Maschinenbau GmbH" to
-- Hugo Vogelsang Maschinenbau GmbH --.

This certificate supersedes the Certificate of Correction issued February 7, 2006.

Signed and Sealed this

Tenth Day of February, 2009

JOHN DOLL
*Acting Director of the United States Patent and Trademark Office*